US006384732B1

(12) United States Patent
Schumer

(10) Patent No.: US 6,384,732 B1
(45) Date of Patent: May 7, 2002

(54) CHRISTMAS TREE SMOKE DETECTOR

(76) Inventor: Joseph A. Schumer, 3644 W. Oakland St., Chandler, AZ (US) 85226

( * ) Notice: Subject to any disclaimer, the term of this patent is extended or adjusted under 35 U.S.C. 154(b) by 0 days.

(21) Appl. No.: 09/644,741

(22) Filed: Aug. 23, 2000

(51) Int. Cl.[7] ..... G08B 17/10
(52) U.S. Cl. ..... 340/629; 340/628; 340/630
(58) Field of Search ..... 340/628, 629, 340/630

(56) References Cited

U.S. PATENT DOCUMENTS 4,623,878 A * 11/1986 Schoenwetter ..... 340/628
5,396,221 A * 3/1995 Bridges ..... 340/628
5,625,345 A * 4/1997 Stark et al. ..... 340/628
5,821,865 A * 10/1998 Solak ..... 340/628

* cited by examiner

*Primary Examiner*—Edward Lefkowitz
(74) *Attorney, Agent, or Firm*—Joseph N. Breaux

(57) ABSTRACT

A smoke detector that is easily attached to the limb of a Christmas tree that includes a smoke detector circuit and an audible alarm circuit for generating an audible alarm in response to detecting smoke. The smoke detector circuit is capable of detecting small amounts of smoke and triggering an alarm. An additional fire detector element is also provided in the form of an infrared detector that detects rapid changes in infrared levels and generate an activation signal for causing the speaker to generate an audible alarm. The housing of the smoke detector has a Christmas decoration theme so as to not detract from the decorations on the Christmas tree.

1 Claim, 4 Drawing Sheets

CHRISTMAS TREE SMOKE DETECTOR

TECHNICAL FIELD

The present invention relates to fire safety devices and more particularly to a Christmas tree smoke detector that includes a housing having a Christmas decorated exterior and a hanging hook suitable for supporting the housing from the limb of a Christmas tree, an air flow passageway between a bottom side of the housing and a top side of the housing, an infrared detector inlet aperture formed through a bottom side of the housing, a push button test switch opening and a power on verification diode opening; and a smoke detector circuit including a test switch operationally installed through the push button test switch opening, a parallel plate ionizing smoke detector positioned in the air flow passageway between the bottom side and the top side of the opening, an infrared detector operationally positioned in connection with the infrared detector inlet aperture so as to detect infrared radiation levels exteriorly of the housing, a piezo speaker for generating an audible alarm, and a control circuit in connection with the test switch, the parallel plate ionizing smoke detector, the infrared detector, the piezo speaker and programmed such that the control circuit causes the piezo speaker to emit an audible alarm when the control circuit is triggered by an activation signal generated by the test switch or a low battery condition, the parallel plate ionizing smoke detector or the infrared detector; the smoke detector circuit being powered by a battery supply positioned within the housing.

BACKGROUND ART

Christmas tree fires can erupt and become totally engulfed in a manner of seconds. It is important, therefore, to have a mechanism for detecting a fire or a smoldering element in a Christmas tree so that the proper response can be made to protect the occupants of the home and save as much property as possible. It would be desirable, therefore, to have a smoke detector that could be easily attached to the limb of a Christmas tree that included a smoke detector circuit and an audible alarm circuit for generating an audible alarm in response to detecting smoke. Because Christmas tree fires can burn very hot without generating large amounts of smoke at the bottom of the tree early in the progress of the fire, it would be further desirable to have a smoke detector capable of detecting small amounts of smoke and triggering an alarm. In addition, it would be further desirable to have an additional fire detector element in the form of an infrared detector that could detect rapid changes in the infrared levels and generate an activation signal for causing the speaker to generate an audible alarm. The Christmas tree smoke detector would also desirably have a housing that would have a Christmas decoration theme so as to not detract from the decorations on the Christmas tree.

GENERAL SUMMARY DISCUSSION OF INVENTION

It is thus an object of the invention to provide a Christmas tree smoke detector that includes a housing having a Christmas decorated exterior and a hanging hook suitable for supporting the housing from the limb of a Christmas tree, an air flow passageway between a bottom side of the housing and a top side of the housing, an infrared detector inlet aperture formed through a bottom side of the housing, a push button test switch opening and a power on verification diode opening; and a smoke detector circuit including a test switch operationally installed through the push button test switch opening, a parallel plate ionizing smoke detector positioned in the air flow passageway between the bottom side and the top side of the opening, an infrared detector operationally positioned in connection with the infrared detector inlet aperture so as to detect infrared radiation levels exteriorly of the housing, a piezo speaker for generating an audible alarm, and a control circuit in connection with the test switch, the parallel plate ionizing smoke detector, the infrared detector, the piezo speaker and programmed such that the control circuit causes the piezo speaker to emit an audible alarm when the control circuit is triggered by an activation signal generated by the test switch or a low battery condition, the parallel plate ionizing smoke detector or the infrared detector; the smoke detector circuit being powered by a battery supply positioned within the housing.

Accordingly, a Christmas tree smoke detector is provided. The Christmas tree smoke detector includes a housing having a Christmas decorated exterior and a hanging hook suitable for supporting the housing from the limb of a Christmas tree, an air flow passageway between a bottom side of the housing and a top side of the housing, an infrared detector inlet aperture formed through a bottom side of the housing, a push button test switch opening and a power on verification diode opening; and a smoke detector circuit including a test switch operationally installed through the push button test switch opening, a parallel plate ionizing smoke detector positioned in the air flow passageway between the bottom side and the top side of the opening, an infrared detector operationally positioned in connection with the infrared detector inlet aperture so as to detect infrared radiation levels exteriorly of the housing, a piezo speaker for generating an audible alarm, and a control circuit in connection with the test switch, the parallel plate ionizing smoke detector, the infrared detector, the piezo speaker and programmed such that the control circuit causes the piezo speaker to emit an audible alarm when the control circuit is triggered by an activation signal generated by the test switch or a low battery condition, the parallel plate ionizing smoke detector or the infrared detector; the smoke detector circuit being powered by a battery supply positioned within the housing.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
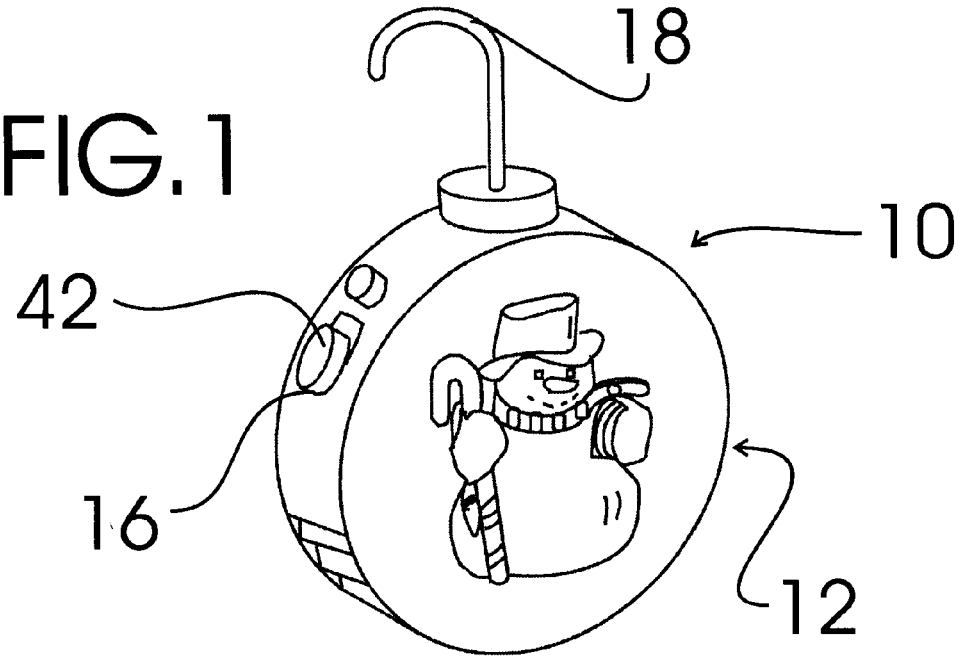
FIG. 1 is a perspective view of an exemplary embodiment of the Christmas tree smoke detector.
Figure 4:
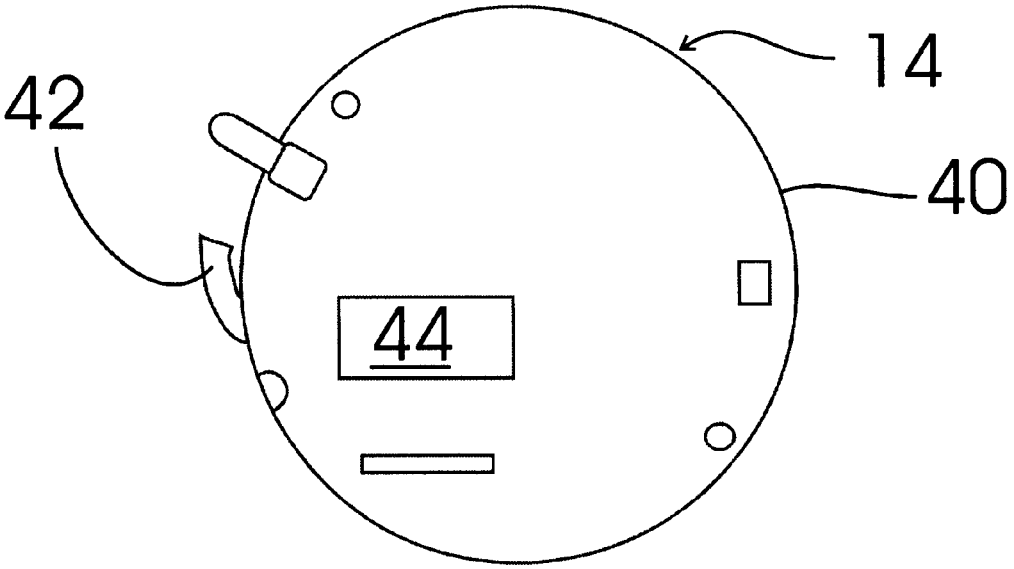
FIG. 4 is a detail plan view of the smoke detector circuit board in isolation.
Figure 2:
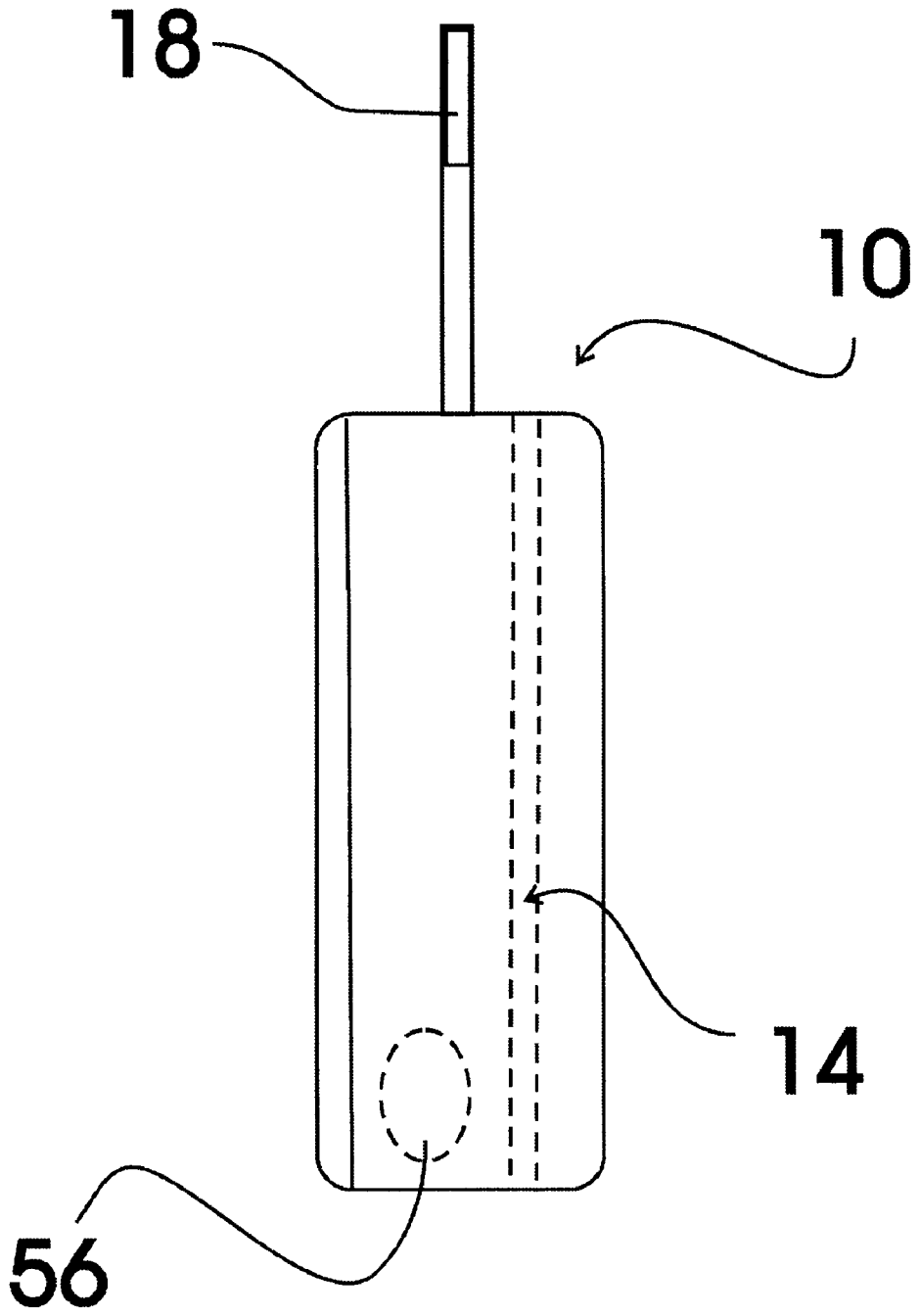
FIG. 2 is a side plan view of the Christmas tree smoke detector of FIG. 1.
Figure 3:
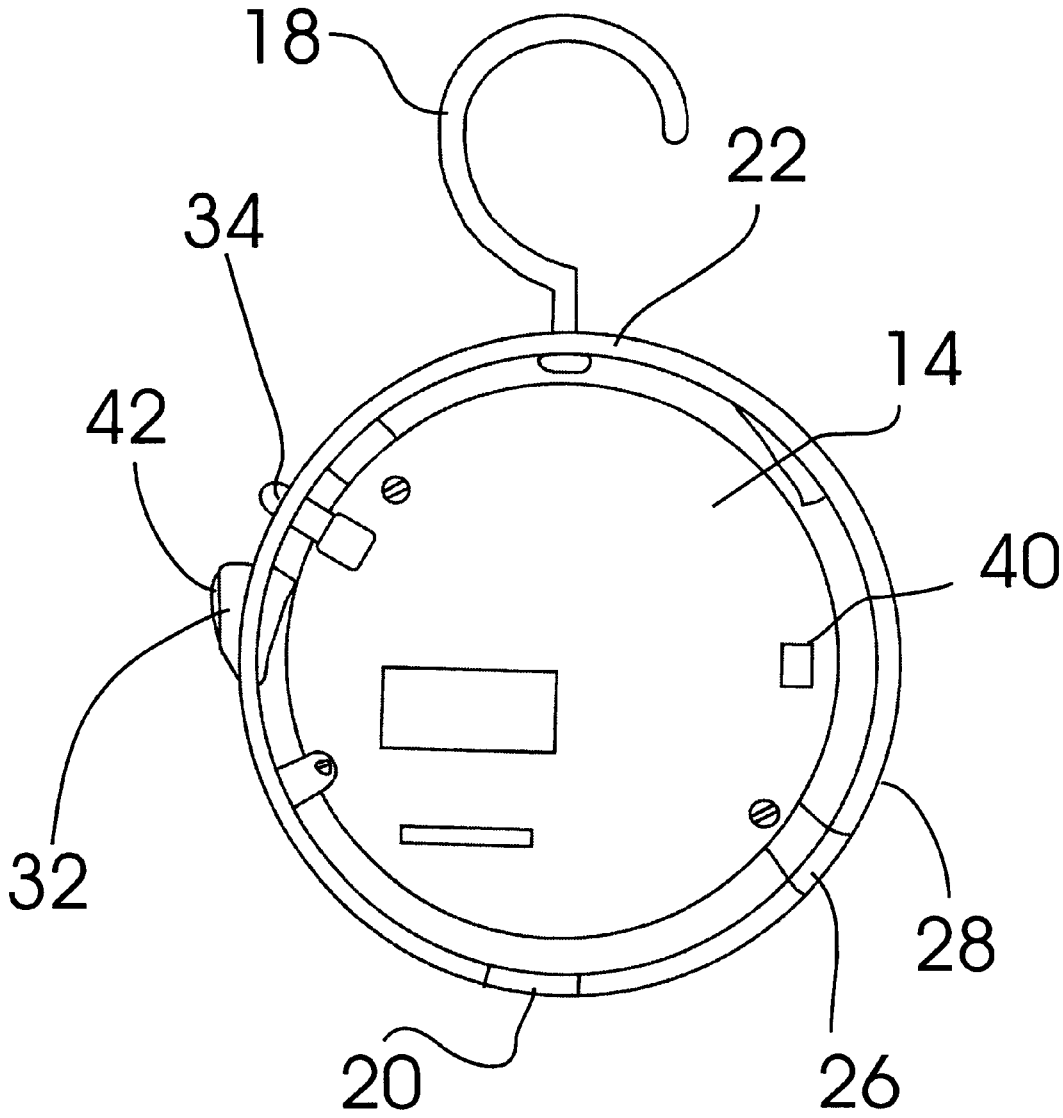
FIG. 3 is a back cutaway view of Christmas tree smoke detector of FIG. 1.
Figure 5:
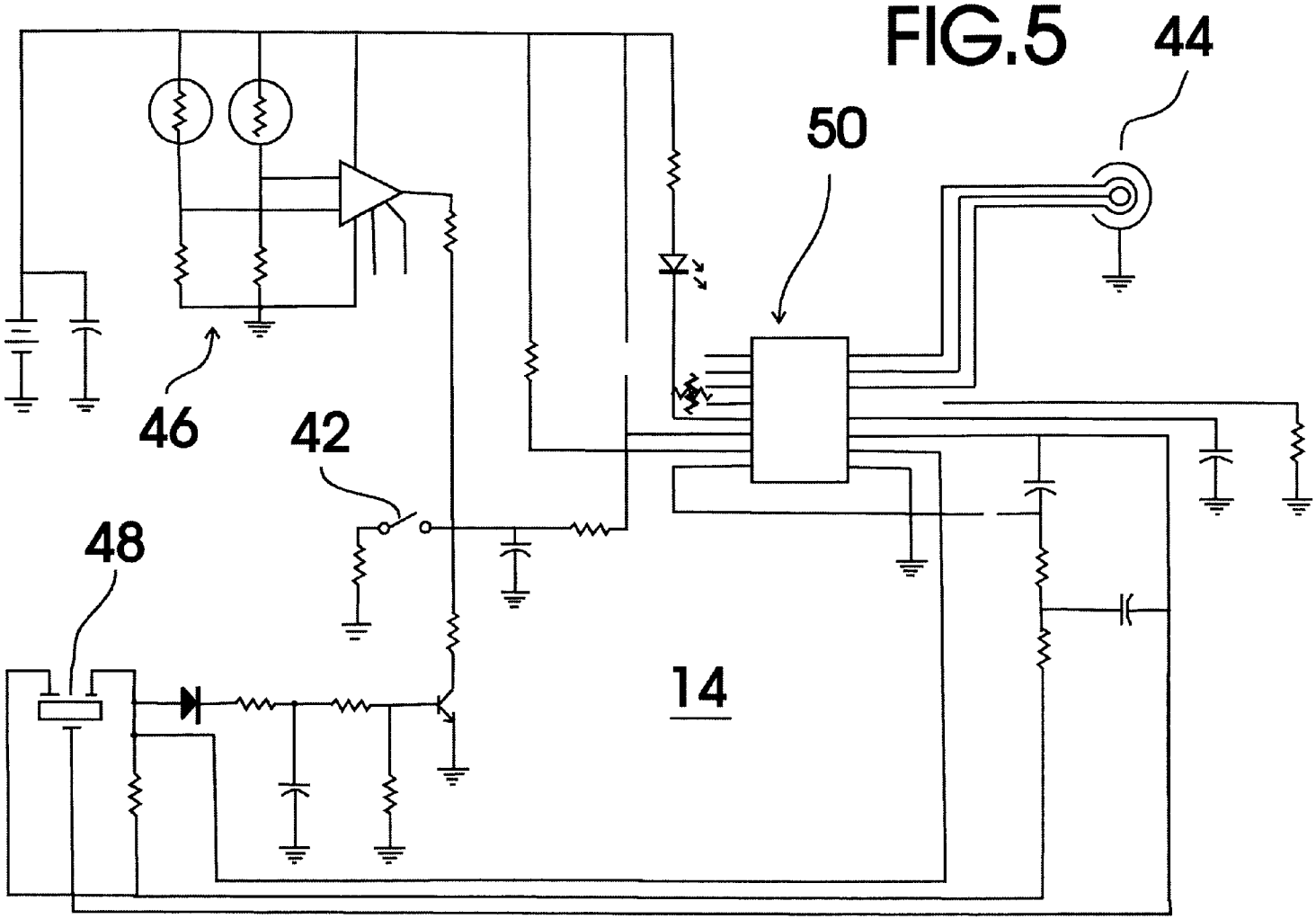
FIG. 5 is a schematic diagram of the smoke detector circuit.

FIGS. 1–5 show various aspects of an exemplary embodiment of the Christmas tree smoke detector of the present invention generally designated 10. Christmas tree smoke detectors 10 includes a housing, generally designated 12, and a smoke detector circuit, generally designated 14. Housing 12 is constructed from plastic and has a Christmas decorated exterior surface 16 and a hanging hook 18 suitable for supporting housing 12 from the limb of a Christmas tree. Housing 10 also includes an air flow passageway between a bottom side opening 20 and a top side opening 22, an infrared detector inlet aperture 26 formed through a bottom side 28 of housing 12, a push button test switch opening 32 and a power on verification diode opening 34.

Smoke detector circuit 14 is constructed on a circuit board 40 including a test switch 42 operationally installed through the push button test switch opening 32, a parallel plate ionizing smoke detector 44 positioned in the air flow passageway between bottom side opening 20 and top side opening 22, an infrared detector 46 operationally positioned in connection with the infrared detector inlet aperture 26 so as to detect infrared radiation levels exteriorly of housing 12, a piezo speaker 48 for generating an audible alarm, and a control circuit 50 in connection with test switch 42, parallel plate ionizing smoke detector 44, infrared detector 46, piezo speaker 48 and programmed such that the control circuit 50 causes piezo speaker 48 to emit an audible alarm when control circuit 50 is triggered by an activation signal generated by the test switch 42 or a low battery condition, the parallel plate ionizing smoke detector 44 or the infrared detector 46. The smoke detector circuit 14 is powered by a battery supply 56 positioned within housing 12.

It can be seen from the preceding description that a Christmas tree smoke detector has been provided.

It is noted that the embodiment of the Christmas tree smoke detector described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Christmas tree smoke detector comprising:

a housing having a Christmas decorated exterior and a hanging hook suitable for supporting the housing from the limb of a Christmas tree, an air flow passageway between a bottom side of the housing and a top side of the housing, an infrared detector inlet aperture formed through a bottom side of the housing, a push button test switch opening and a power on verification diode opening; and a smoke detector circuit including a test switch operationally installed through the push button test switch opening, a parallel plate ionizing smoke detector positioned in the air flow passageway between the bottom side and the top side of the opening, an infrared detector operationally positioned in connection with the infrared detector inlet aperture so as to detect infrared radiation levels exteriorly of the housing, a piezo speaker for generating an audible alarm, and a control circuit in connection with the test switch, the parallel plate ionizing smoke detector, the infrared detector, the piezo speaker and programmed such that the control circuit causes the piezo speaker to emit an audible alarm when the control circuit is triggered by an activation signal generated by the test switch or a low battery condition, the parallel plate ionizing smoke detector or the infrared detector;

the smoke detector circuit being powered by a battery supply positioned within the housing.

* * * * *